US009834286B2

(12) United States Patent
Rubey

(10) Patent No.: US 9,834,286 B2
(45) Date of Patent: Dec. 5, 2017

(54) BUOYANT POOL FLOAT

(71) Applicant: TRC Recreation, LP, Wichita Falls, TX (US)

(72) Inventor: Ulyss Ray Rubey, Graham, TX (US)

(73) Assignee: TRC Recreation, LP, Wichita Falls, TX (US)

( * ) Notice: Subject to any disclaimer, the term of this patent is extended or adjusted under 35 U.S.C. 154(b) by 0 days.

(21) Appl. No.: 15/398,320

(22) Filed: Jan. 4, 2017

(65) Prior Publication Data

US 2017/0190392 A1 Jul. 6, 2017

Related U.S. Application Data

(60) Provisional application No. 62/274,656, filed on Jan. 4, 2016.

(51) Int. Cl.

| | |
|---|---|
| ***A47C 1/14*** | (2006.01) |
| ***B63B 35/74*** | (2006.01) |
| ***B63B 35/73*** | (2006.01) |
| ***A47C 15/00*** | (2006.01) |

(52) U.S. Cl.

CPC ..... *B63B 35/73* (2013.01); *A47C 15/006* (2013.01)

(58) Field of Classification Search

CPC ..... B63B 35/79; B63B 2035/7903; B63B 35/7906; B63B 35/7909; B63B 35/7916; B63B 35/7953; A47C 15/006; A47C 1/14; B63C 9/28; B63C 9/30

See application file for complete search history.

(56) References Cited

U.S. PATENT DOCUMENTS

| | | | | |
|---|---|---|---|---|
| D169,366 | S | 4/1953 | Feldman | |
| 2,724,133 | A | 11/1955 | Sorrell | |
| 3,067,441 | A | 12/1962 | Dysard et al. | |
| 3,102,280 | A | 9/1963 | Williams | |
| 3,323,151 | A | 6/1967 | Lerman | |
| 3,363,272 | A * | 1/1968 | Channon | A47C 17/64 441/129 |

(Continued)

FOREIGN PATENT DOCUMENTS

| | | | | |
|---|---|---|---|---|
| GB | 1397456 A * | 6/1975 | ..... | B63B 35/73 |

OTHER PUBLICATIONS

Amazon, Baltic Living Door Stop. Publication address at https://www.amazon.com/Flexible-Stopper-Baltic-Living-Doorstop/dp/B00XHMMPWO, Sale Date Jul. 9, 2015. Retrieved Jun. 23, 2016.*

*Primary Examiner* — Andrew Polay

(74) *Attorney, Agent, or Firm* — Scott T. Griggs; Griggs Bergen LLP

(57) ABSTRACT

A buoyant pool float for floating in water is disclosed. In one embodiment, the buoyant pool float includes a body having a four-piece construction including an upper flotation member and a lower flotation member having a sidewall and bulkhead interposed therebetween. The upper flotation member is generally flat and sized to accommodate a human in a semi-reclining or reclining position, for example. Further, the upper flotation member is superposed above the lower flotation member, which is sized to correspond to a front end of the upper flotation member. The sidewall is positioned about the exterior of the body and the bulkhead within the interior of the body such that two sealed air holds are provided within the buoyant pool float. The two sealed air holds contribute to stability and buoyancy.

19 Claims, 4 Drawing Sheets

(56) References Cited

U.S. PATENT DOCUMENTS

| | | | | |
|---|---|---|---|---|
| D224,138 | S | 7/1972 | Mahler | |
| 3,860,976 | A | 1/1975 | Suyama | |
| 3,984,888 | A | 10/1976 | DeLano | |
| 4,275,473 | A | 6/1981 | Poirier | |
| 4,316,629 | A | 2/1982 | Jacoby | |
| 4,358,866 | A | 11/1982 | Rhodes | |
| 4,451,240 | A | 5/1984 | Wood | |
| 4,528,705 | A | 7/1985 | Greenwalt | |
| 4,564,240 | A | 1/1986 | Thieme | |
| 4,662,852 | A | 5/1987 | Schneider et al. | |
| 4,799,910 | A | 1/1989 | Kellough | |
| 4,894,034 | A * | 1/1990 | Brown, III | B63B 35/7906 280/18.1 |
| 4,986,781 | A | 1/1991 | Smith | |
| 5,004,296 | A | 4/1991 | Ziegenfuss | |
| 5,009,623 | A * | 4/1991 | Lueschen | B63B 35/7906 441/56 |
| 5,088,723 | A | 2/1992 | Simmons | |
| D325,185 | S | 4/1992 | Markiw | |
| D344,120 | S | 2/1994 | Helt et al. | |
| 5,403,220 | A | 4/1995 | Goad, Sr. | |
| 5,439,405 | A | 8/1995 | Storey et al. | |
| D376,692 | S | 12/1996 | Hartman | |
| D392,495 | S | 3/1998 | Baousson | |
| 6,045,423 | A | 4/2000 | Silvia | |
| 6,086,150 | A | 7/2000 | Scheurer et al. | |
| 6,126,504 | A | 10/2000 | Day | |
| D433,861 | S | 11/2000 | Rose et al. | |
| 6,312,054 | B1 | 11/2001 | Scheurer et al. | |
| D487,551 | S | 3/2004 | Lee | |
| 6,746,293 | B1 | 6/2004 | Kirby et al. | |
| 6,783,181 | B2 | 8/2004 | Scheurer et al. | |
| 6,991,285 | B1 | 1/2006 | Hemenway | |
| D529,327 | S | 10/2006 | Martin et al. | |
| 7,150,057 | B1 | 12/2006 | Santiago et al. | |
| D582,611 | S | 12/2008 | Bise | |
| 7,571,965 | B1 | 8/2009 | Perry | |
| D612,188 | S | 3/2010 | Yiannaki | |
| D620,300 | S | 7/2010 | Rubey | |
| 9,139,263 | B2 | 9/2015 | Rubey | |
| 9,408,474 | B2 | 8/2016 | Rubey | |
| 2008/0116619 | A1 * | 5/2008 | Cheung | B29C 47/0019 264/480 |
| 2009/0025731 | A1 | 1/2009 | Hsu | |
| 2010/0273372 | A1 * | 10/2010 | Parsia | B63B 35/79 441/74 |

* cited by examiner

BUOYANT POOL FLOAT

PRIORITY STATEMENT & CROSS-REFERENCE TO RELATED APPLICATIONS

This application claims priority from U.S. Patent Application No. 62/274,656, entitled "Buoyant Pool Float" and filed on Jan. 4, 2016, in the name of Ulyss Ray Rubey; which is hereby incorporated by reference for all purposes.

TECHNICAL FIELD OF THE INVENTION

This invention relates, in general, to swimming pool recreational accessories and, more particularly, to a buoyant pool float for supporting a person in a sitting or reclining position, for example, while the buoyant pool float is floating in the water.

BACKGROUND OF THE INVENTION

Swimming pools offer recreation and relaxation in a variety of settings, including private homes, apartment complexes, motels, resorts, and country clubs. Various flotation devices, including buoyant chairs, rafts, water wings, floating cushions, body floats and air mattresses are used by swimmers as an aid for floating and relaxing on the surface of the water, while remaining in a seated or reclining position, with varying degrees of submergence. These items of pool furniture include flotation cushions made of a buoyant material such as open cell foam, closed cell foam, cork, kapok, fiberglass or balsa wood, which are sealed within a protective outer coating. Special care should be taken in the construction of buoyant lounge chairs to provide sufficient buoyance material to maintain a stable upright orientation, while the occupant is in a semi- or fully-reclining orientation. As can be appreciated, the buoyant pool float may overturn in response to shifting of its center of buoyancy as the occupant turns or moves about and, as a result, there is a continuing need for improved design.

SUMMARY OF THE INVENTION

It would be advantageous to achieve a buoyant pool float serving as a swimming pool recreational accessory for a swimmer in an upright, semi-reclining, sitting, or reclining position, for example, that would improve upon existing limitations in stability and functionality. It would also be desirable to enable a mechanical solution that would mitigate or eliminate the chances of the buoyant pool lounge chair being overturned in response to shifting of its center or buoyancy. Further, it would be desirable to enable a mechanical solution that provides a buoyant pool lounge chair while providing improved value engineering and construction. To better address one or more of these concerns, a buoyant pool float is disclosed.

In one embodiment, the buoyant pool float includes a body having a four-piece construction including an upper flotation member and a lower flotation member having a sidewall and bulkhead interposed therebetween. The upper flotation member is generally flat and sized to accommodate a human in a semi-reclining or reclining position, for example. Further, the upper flotation member is superposed above the lower flotation member, which is sized to correspond to a front end of the upper flotation member. The sidewall is positioned about the exterior of the body and the bulkhead within the interior of the body such that two sealed air holds are provided within the buoyant pool float. The two sealed air holds contribute to stability and buoyancy. Additionally, two areas that extend from the upper flotation member contribute to stability and buoyancy.

In another embodiment, the buoyant pool float includes a body having a two-piece construction including an upper flotation member and a sidewall extending downward therefrom. The upper flotation member is generally flat and sized to accommodate a human in a semi-reclining or reclining position, for example. The upper flotation member may be generally half-diamond shaped in plan or oval shaped in plan, for example. The sidewall is positioned about the exterior of the body from which it extends and shaped to provide an unsealed air hold that contributes to stability and buoyancy. These and other aspects of the invention will be apparent from and elucidated with reference to the embodiments described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Figure 1:
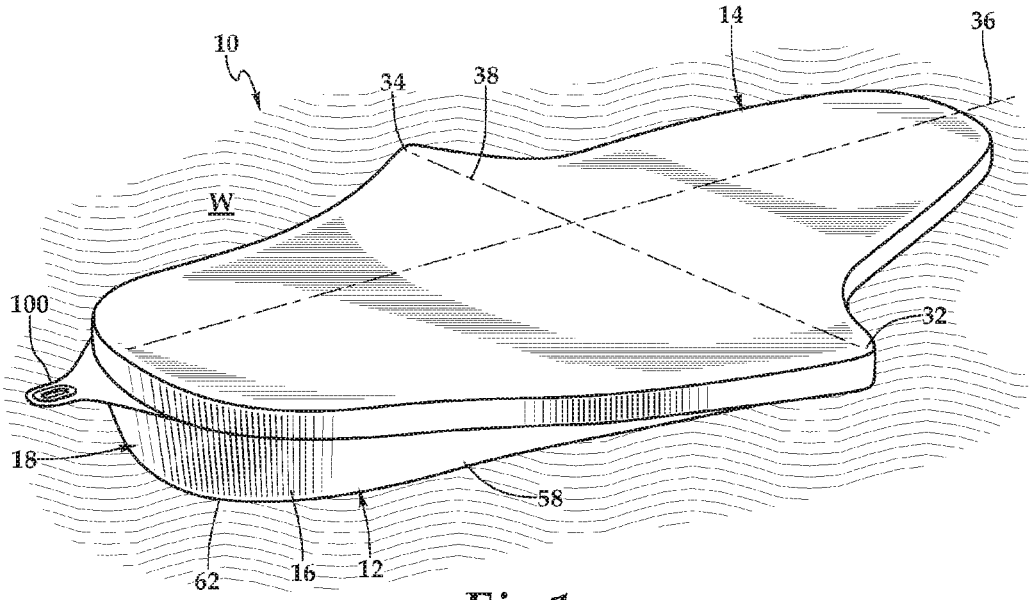
FIG. 1 is a front top perspective view of one embodiment of a buoyant pool float according to the teachings presented herein that is floating in water.
Figure 2:
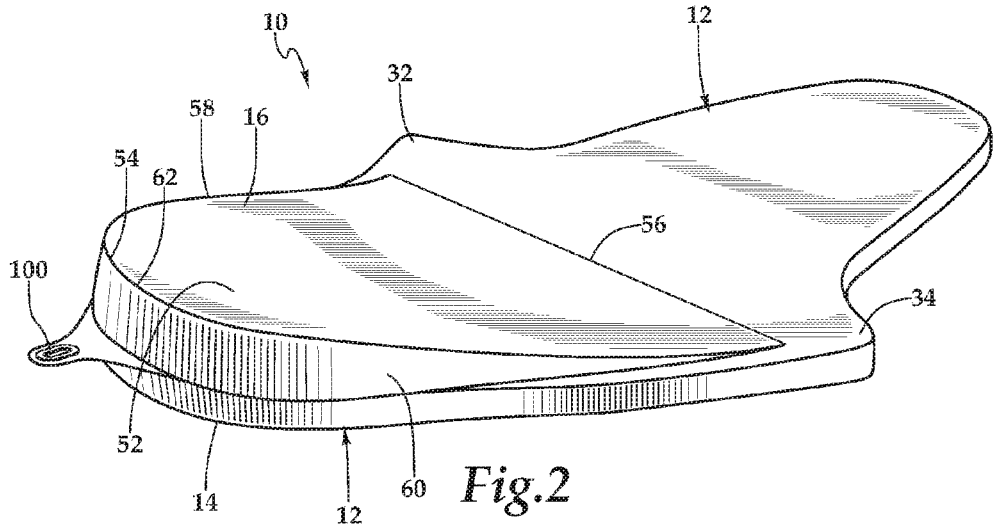
FIG. 2 is a front bottom perspective view of the buoyant pool float depicted in FIG. 1.
Figure 3:
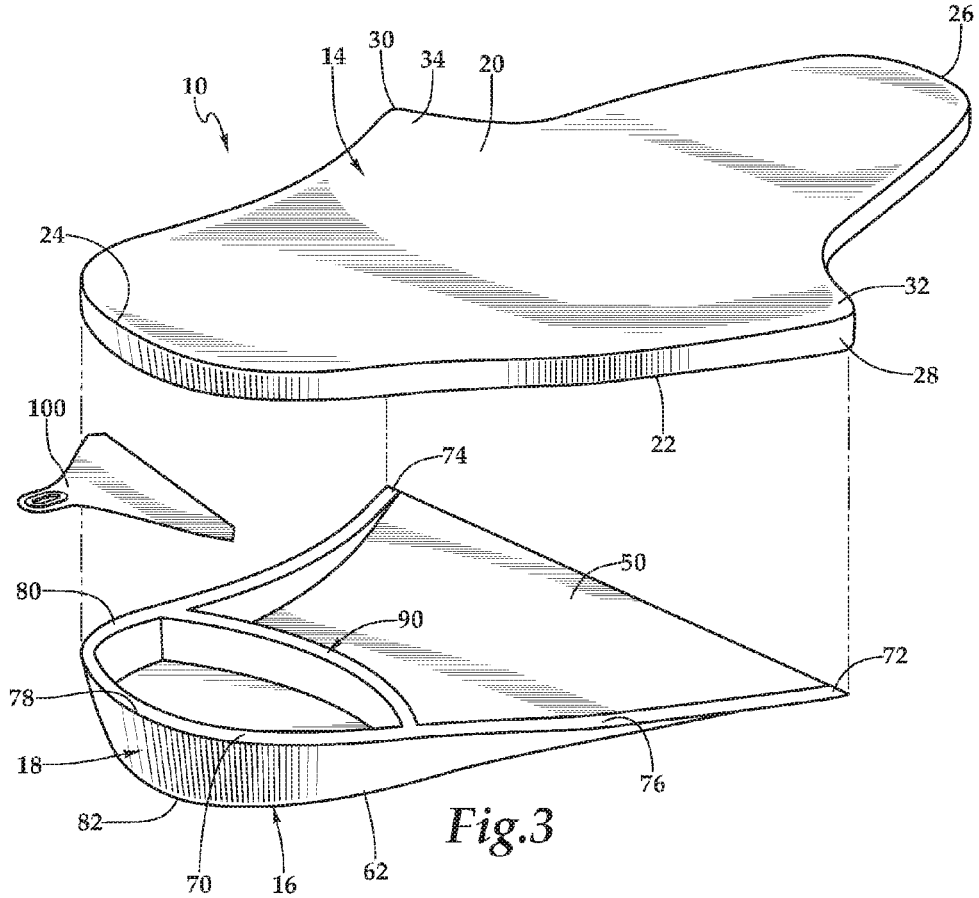
FIG. 3 is a front top exploded view of the buoyant pool float depicted in FIG. 1.
Figure 4:
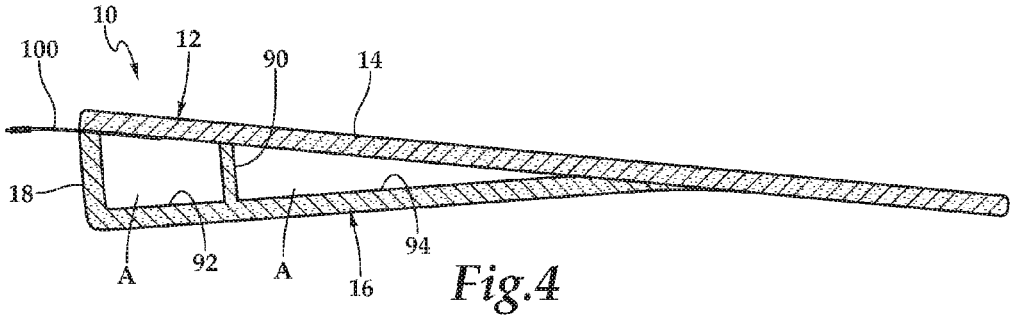
FIG. 4 is a right side cross-sectional view of the buoyant pool float depicted in FIG. 1.

Referring now to FIG. 1 through FIG. 4, therein is depicted one embodiment of a buoyant pool float 10, which is schematically illustrated and designed. As shown, the buoyant pool float 10 floats on water W and includes a body 12 including an upper flotation member 14 and a lower flotation member 16 having a sidewall 18 interposed therebetween. Both the upper flotation member 14 and the lower flotation member 16 may be substantially flat.

The upper flotation member 14 includes a top 20, a bottom 22, a front end 24, a rear end 26, a side 28, and a side 30. In one embodiment, the upper flotation member 14 is generally diamond shape in plan with the front and rear ends 24, 26 rounded. The sides 28, 30 may be extended to accommodate respective arms 32, 34 extending toward the rear end 26. As depicted, the upper flotation member 14 includes a longitudinal axis 36 and a transverse axis 38 with the respective arms 32, 34 being proximate to the transverse axis 38. The upper flotation member 14 is sized for a human oriented in a semi-reclining or reclining position, for example, such that the front end 24 of the upper flotation member 14 includes a size to accommodate a human head and the rear end 26 of the upper flotation member 14 includes a size to accommodate human feet.

In one implementation, the lower flotation member 16 includes a top 50, a bottom 52, a front end 54, a rear end 56, a side 58, and a side 60. The lower flotation member 16 may be generally half-diamond shape in plan with the front end 54 being rounded. The rear end 56, on the other hand, is truncated. As shown, the sides 58, 60 are flared outward from the front end 54 to the rear end 56 and a forward edge 62 curves around the sides 58, 60, the front end 54, and the rear end 56. As such, the lower flotation member 16 is approximately half the size of the upper flotation member 14.

In one embodiment, the sidewall 18 includes a generally U-shaped ramp 70 having feet 72, 74 at the rear end 26 of lower flotation member 16 proximate to the transverse axis 38 of the upper flotation member 14. The generally U-shaped ramp 70 may include a rise 76 from the feet 72, 74 to a peak 78 at the front end 24 of the upper flotation member 14 and the front end 24 of the lower flotation member 16. The generally U-shaped ramp 70 has an upper edge 80 and a lower edge 82. The upper edge 80 contacts the upper flotation member 14 and the lower edge 82 is coincident with the forward edge 62 of the lower flotation member 16. As illustrated, the arms 32, 34 of the upper flotation member 14 extend beyond the lower flotation member 16.

A bulkhead 90 is located in a crossbar position across the generally U-shaped ramp 70 and forms a sealed air hold 92 and a sealed air hold 94. Each of the sealed air holds 92, 94 contain air A. The sealed air hold 92 is proximate the front end 24 of the upper flotation member 14 and the front end 24 of the lower flotation member 16. The sealed air hold 94 is proximate the transverse axis 38 of the upper flotation member 14 and the rear end 26 of the lower flotation member 16. The sealed air hold 92 and the sealed air hold 94 include non-inflatable designs. It should be appreciated that although two sealed air holds 92, 94 are depicted, the buoyant pool float 10 may have a single sealed air hold or more than two sealed air holds. As shown, the sealed air hold 92 is positioned under the front end 24 of the upper flotation member 14 such that the front end 24 of the upper flotation member 14 is inclined and elevated relative to the rear end 26 of the upper flotation member 14. This arrangement further assists the buoyancy by providing inclined support to the head, shoulders, and torso of the individual or human utilizing the buoyant pool float 10. A loop hanger 100 may extend from the front end 24 of the upper flotation member 14. The loop hanger 100 facilitates hanging of the buoyant pool float 10 for storage.

As constructed, in one embodiment, the buoyant pool float 10 may be designed as a continuous form of a pliable foam material of constant or appropriately varying density that varies in thickness with a coating applied thereon to provide the upper flotation member 14, the lower flotation member 16, the sidewall 18, and the bulkhead 90. The construction may include molded foam being provided by a single or multiple molding process, and, in one embodiment, may include void spaces of select shapes to accommodate cup holders or the like. In one embodiment, the construction includes slabs of closed cell polyurethane foam, such as closed cell polyurethane foam, having a density in the range of approximately 1 lbs/ft$^3$ (16 kg/m$^3$) to approximately 6 lbs/ft$^3$ (96 kg/m$^3$). Further, by way of example, the upper flotation member 14 may be made by a partially or fully blow molded process depending on volumes. During construction, the sealed air holds 92, 94 are constructed by closing ambient air therein during assembly.

By way of example and not by way of limitation, the buoyant pool float 10 may be constructed such that the length along the longitudinal axis 36 is over about 6.5 feet (1.98 m) from the rear end 26 of the upper flotation member 14 to the front end 24 of the upper flotation member 14. The width of the buoyant pool float 10 may be about 38 inches (965.2 mm) from the arm 32 to the arm 34 across the transverse axis 38 of the upper flotation member 14. The front end 24 of the upper flotation member 14 may have a width of about 17.5 inches (444.5 mm) and the upper flotation member 14 may have a width of about 27 inches (685.8 mm), distal to the arms 32, 34 that tapers down further toward the rear end 26 of the upper flotation member 14. The height of the body 12 at the front end 24 of the upper flotation member 14 and the lower flotation member 16 may be about 6.5 inches (165.1 mm). It should be appreciated that although a particular construction and materials are presented herein, the construction of the buoyant pool float 10 presented herein may vary according to the particular application and other constructions and choices of materials are within the teachings presented herein.

As previously alluded, special care should be taken in the consideration of buoyant lounge chairs to provide sufficient buoyancy material to maintain a stable upright orientation while the occupant is in a semi-reclining, seated, or reclining orientation, for example. Such special care is warranted as any buoyant lounge chair or buoyant pool float can overturn in response to shifting of its center of buoyancy as the occupant turns or moves about. In one embodiment of the buoyant pool float 10, buoyancy sufficient to support an adult occupant having a body weight of 250 lbs (113 kg) is provided by the construction. In particular, buoyance may be achieved through the four-piece construction including the upper flotation member 14 and the lower flotation member 16 having the sidewall 18 and the bulkhead 90 interposed therebetween.

As discussed, the upper flotation member 14 is generally flat and sized to accommodate a human. Further, the upper flotation member 14 is superposed above the lower flotation member 16, which is sized to correspond to the front end 24, beyond the transverse axis 38, of the upper flotation member 14. The sidewall 18 is positioned at the exterior of the buoyant pool float 10 and the bulkhead 90 within the interior thereof such that two sealed air holds 92, 94 are provided within the buoyant pool float 10. The two sealed air holds 92, 94 contribute to stability and buoyancy. Moreover, the extended arms 32, 34 add to the stability and buoyancy of the buoyant pool float 10 too. In one exemplary prototype constructed according to the teachings presented herein, the buoyant pool float 10 required 20 percent less material to construct than an equivalent sized regular buoyant pool float 10 using existing construction designs and techniques.

Figure 5:
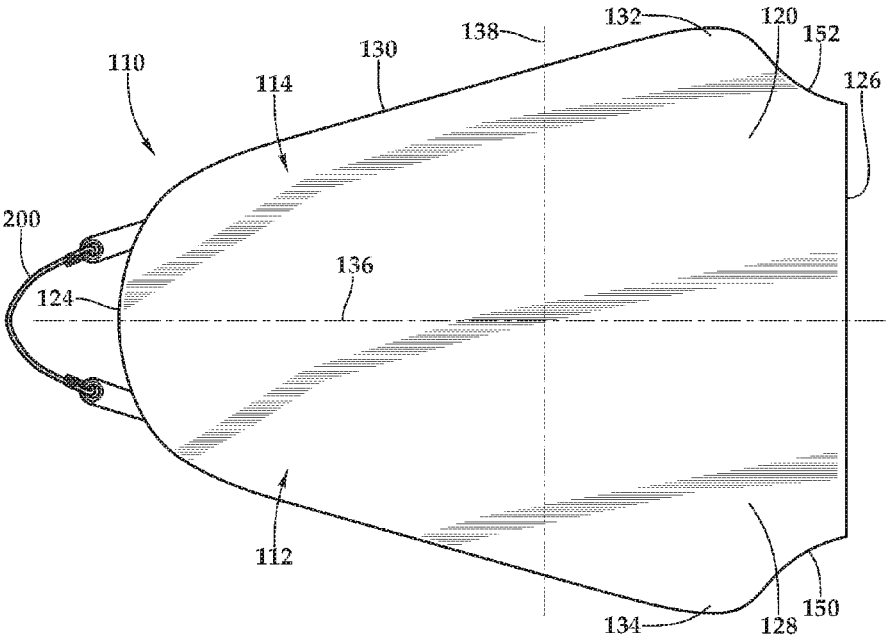
FIG. 5 is a top plan view of another embodiment of a buoyant pool float according to the teachings presented herein.
Figure 6:
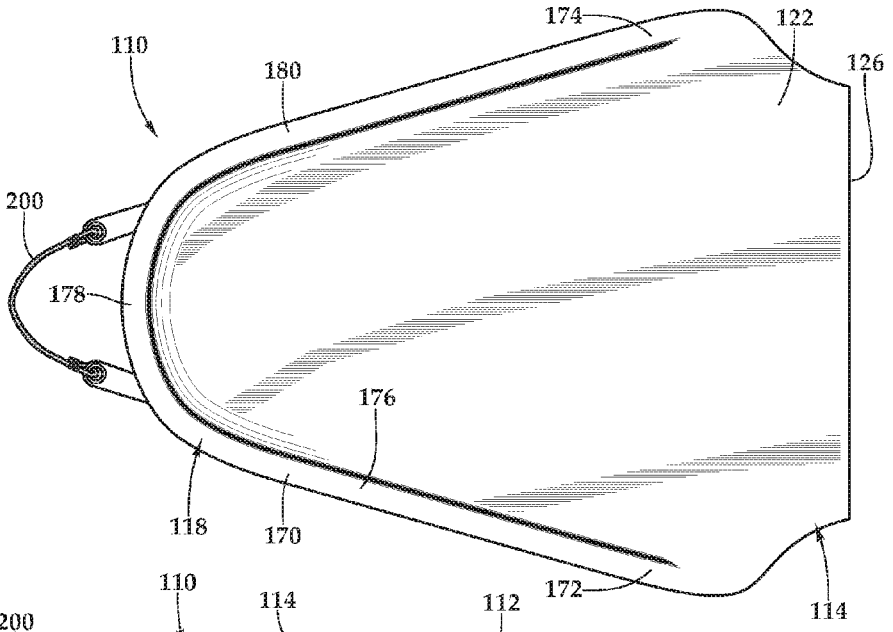
FIG. 6 is a bottom plan view of the buoyant pool float depicted in FIG. 5.
Figure 7:
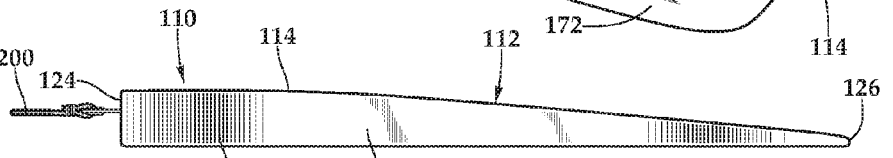
FIG. 7 is a left side elevation view of the buoyant pool float depicted in FIG. 5.
Figure 8:
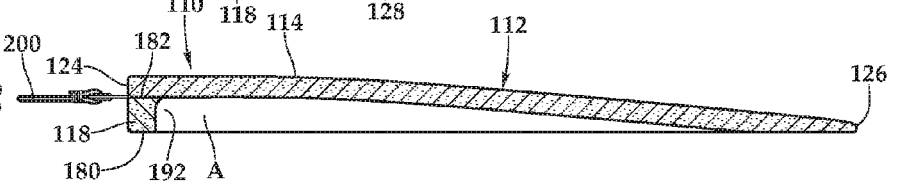
FIG. 8 is a left side cross-sectional view of the buoyant pool float depicted in FIG. 5.

Referring now to FIG. 5 through FIG. 8, therein is depicted another embodiment of a buoyant pool float 110, which is schematically illustrated and designed. As shown, the buoyant pool float 110 floats on water like the buoyant pool float 10 and includes a body 112 including an upper flotation member 114 and a sidewall 118 extending downward therefrom. The upper flotation member 114 may be substantially flat.

The upper flotation member 114 includes a top 120, a bottom 122, a front end 124, a rear end 126, a side 128, and a side 130. In one embodiment, the upper flotation member 114 is generally half-diamond shape in plan with the front end 124 rounded. The sides 128, 130 may be extended to accommodate respective arms 132, 134 extending toward the rear end 126. As depicted, the upper flotation member 114 includes a longitudinal axis 136 and a transverse axis 138 with the respective arms 132, 134 being proximate to the transverse axis 138. The rear end 126 may be straight with respective concave curve members 150, 152 joining the arms 132, 134 to the rear end 126. The upper flotation member 114 is sized for a human oriented in a semi-reclining or reclining position, for example, such that the front end 124 of the upper flotation member 114 includes a size to accommodate a human head and the rear end 126 of the upper flotation member 114 includes a size to accommodate human feet. Alternatively, in one embodiment, the upper flotation member 114 includes support for at least a portion of the lower body of a human utilizing the buoyant pool float 110.

In one embodiment, the sidewall 118 includes a generally U-shaped ramp 170 having feet 172, 174 at the rear end 126 of upper flotation member 114 subjacent to the transverse axis 138 of the upper flotation member 114 on the bottom 122. The generally U-shaped ramp 170 may include a rise 176 from the feet 172, 174 to a peak 178 at the front end 124 of the upper flotation member 114. The generally U-shaped ramp 170 has an upper edge 180 and a lower edge 182. The upper edge 180 contacts the upper flotation member 114 on the bottom 122 and the lower edge 182 extends from the bottom 122 of the upper flotation member 114.

The U-shaped ramp 170 forms an unsealed air hold 192 that is proximate the front end 124 of the upper flotation member 114, whereby air is contained within the unsealed air hold 192 between the buoyant pool float 110 and the water during operation. This arrangement further assists the buoyancy by providing inclined support to the head, shoulders, and torso of the individual or human utilizing the buoyant pool float 110. A grommet and rope hanger 200 may extend from the front end 124 of the upper flotation member 114. The grommet and rope hanger 200 facilitates hanging of the buoyant pool float 110 for storage.

Figure 9:
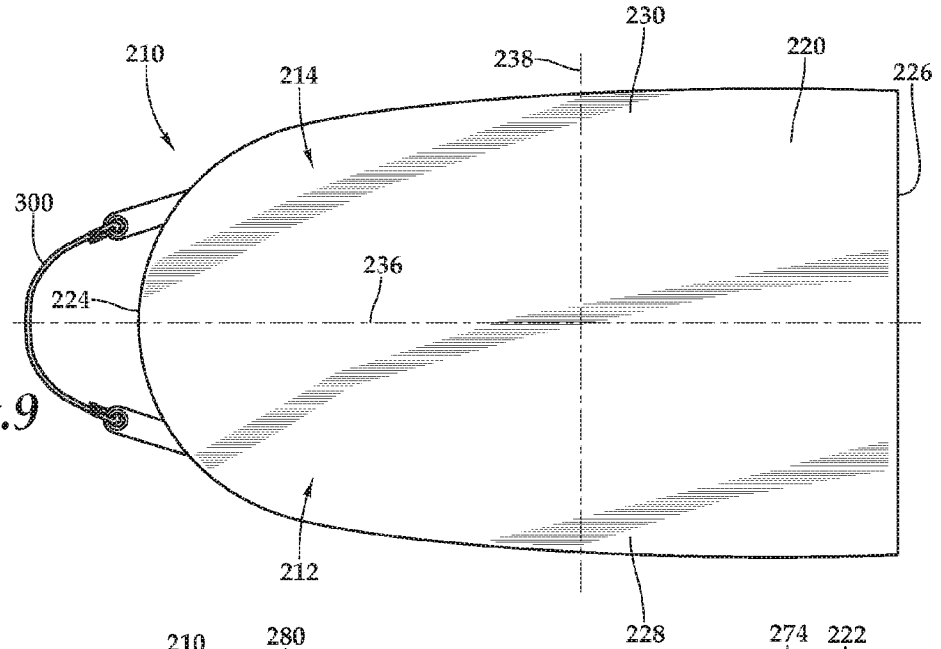
FIG. 9 is a top plan view of a further embodiment of a buoyant pool float according to the teachings presented herein.
Figure 10:
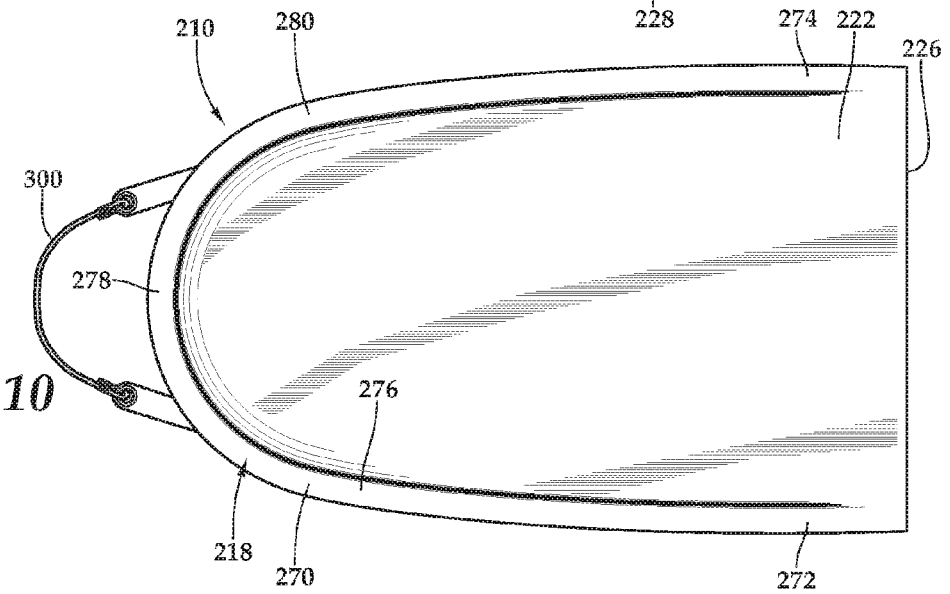
FIG. 10 is a bottom plan view of the buoyant pool float depicted in FIG. 9.
Figure 11:
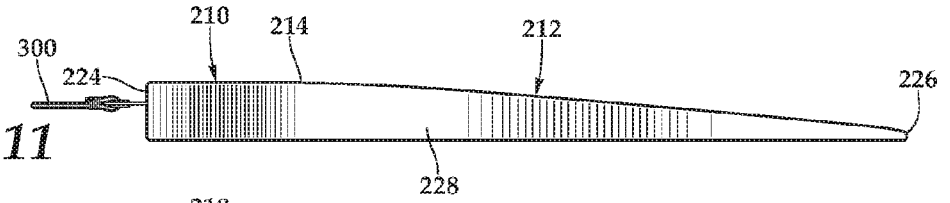
FIG. 11 is a left side elevation view of the buoyant pool float depicted in FIG. 9.
Figure 12:
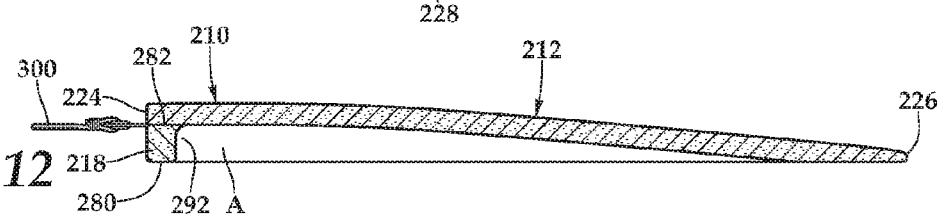
FIG. 12 is a left side cross-sectional view of the buoyant pool float depicted in FIG. 9.

Referring now to FIG. 9 through FIG. 12, therein is depicted another embodiment of a buoyant pool float 210, which is schematically illustrated and designed. As shown, the buoyant pool float 210 floats on water like the buoyant pool floats 10, 110 and includes a body 212 including an upper flotation member 214 and a sidewall 218 extending downward therefrom. The upper flotation member 214 may be substantially flat.

The upper flotation member 214 includes a top 220, a bottom 222, a front end 224, a rear end 226, a side 228, and a side 230. In one embodiment, the upper flotation member 214 is generally oval shape in plan. As depicted, the upper flotation member 214 includes a longitudinal axis 236 and a transverse axis 238. The rear end 226 may be truncated and straight subjacent to the transverse axis 238. The upper flotation member 214 is sized for a human oriented in a semi-reclining or reclining position, for example, such that the front end 224 of the upper flotation member 214 includes a size to accommodate a human head and the rear end 226 of the upper flotation member 214 includes a size to accommodate human feet. Alternatively, in one embodiment, the upper flotation member 214 includes support for at least a portion of the lower body of a human utilizing the buoyant pool float 210. It should be appreciated that the upper flotation member 214 may be any elongated geometric shape, including the aforementioned half-diamond and oval shapes. Further, the construction and sizing of the buoyant pool floats 110, 210 may be similar construction and sizing of the buoyant pool float 10.

In one embodiment, the sidewall 218 includes a generally U-shaped ramp 270 having feet 272, 274 at the rear end 226 of upper flotation member 214 subjacent to the transverse axis 238 of the upper flotation member 214 on the bottom 222. The generally U-shaped ramp 270 may include a rise 276 from the feet 272, 274 to a peak 278 at the front end 224 of the upper flotation member 214. The generally U-shaped ramp 270 has an upper edge 280 and a lower edge 282. The upper edge 280 contacts the upper flotation member 214 on the bottom 222 and the lower edge 282 extends from the bottom side 222 of the upper flotation member 214.

The U-shaped ramp 270 forms an unsealed air hold 292 that is proximate the front end 224 of the upper flotation member 214, whereby air is contained within the unsealed air hold 292 between the buoyant pool float 210 and the water during operation. This arrangement further assists the buoyancy by providing inclined support to the head, shoulders, and torso of the individual or human utilizing the buoyant pool float 210. A grommet and rope hanger 300 may extend from the front end 224 of the upper flotation member 214. The grommet and rope hanger 300 facilitates hanging of the buoyant pool float 210 for storage.

The order of execution or performance of the methods and manufacturing operations illustrated and described herein is not essential, unless otherwise specified. That is, elements of the methods and manufacturing operations may be performed in any order, unless otherwise specified, and that the methods may include more or less elements than those disclosed herein. For example, it is contemplated that executing or performing a particular element before, contemporaneously with, or after another element are all possible sequences of execution.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A buoyant pool float for floating in water, the buoyant pool float comprising:

a body including an upper flotation member and a lower flotation member having a sidewall interposed therebetween;

the upper flotation member having a first end, a second end, a first side, and a second side, the upper flotation member being generally diamond shape in plan with the first and second ends being rounded and the first and second sides being extended to accommodate respective first and second arms extending toward the second end, the upper flotation member having a longitudinal axis and a transverse axis, the respective first and second arms being proximate to the transverse axis;

the lower flotation member having a first end, a second end, a first side, and a second side, the lower flotation member being generally half-diamond shape in plan with the first end being rounded, the second end being truncated, the first and second sides being flare-outward from the first end to the second end, a forward edge curving around the first side, the first end, and the second end;

the sidewall including a generally U-shaped ramp having first and second feet at the second end of lower flotation member proximate to the transverse axis of the upper flotation member, the generally U-shaped ramp having a rise from the first and second feet to a peak at the first end of the upper flotation member and the first end of the lower flotation member, the generally U-shaped ramp having an upper edge and a lower edge, the upper edge contacting the upper flotation member and the lower edge being coincident with the forward edge of the lower flotation member;

the first end of the upper flotation member being inclined and elevated relative to the second end of the upper flotation member such that the first end of the upper flotation member is configured to provide inclined support to the head, shoulders, and torso of a human utilizing the buoyant pool float; and a bulkhead being located in a crossbar position across the generally U-shaped ramp, the bulkhead forming a first sealed air hold and a second sealed air hold, the first sealed air hold being proximate the first end of the upper flotation member and the first end of the lower flotation member, the second sealed air hold being proximate the transverse axis of the upper flotation member and the second end of the lower flotation member.

2. The buoyant pool float as recited in claim 1, wherein the first and second arms extend beyond the lower flotation member.

3. The buoyant pool float as recited in claim 1, wherein the upper flotation member is substantially flat.

4. The buoyant pool float as recited in claim 1, further comprising a loop hanger extending from the first end of the upper flotation member, the loop hanger configured to facilitate hanging of the buoyant pool float for storage.

5. The buoyant pool float as recited in claim 1, wherein the lower flotation member is substantially flat.

6. The buoyant pool float as recited in claim 1, wherein the first end of the upper flotation member further comprises a size to accommodate a human head of an individual using the buoyant pool float.

7. The buoyant pool float as recited in claim 1, wherein the second end of the upper flotation member further comprises a size to accommodate human feet of an individual using the buoyant pool float.

8. The buoyant pool float as recited in claim 1, wherein the first sealed air hold and the second sealed air hold comprise a non-inflatable design, wherein the first sealed air hold and the second sealed air hold are inflated with ambient air at time of construction.

9. A buoyant pool float for floating in water, the buoyant pool float comprising:

a body including an upper flotation member and a sidewall extending downward therefrom;

the upper flotation member having a first end, a second end, a first side, and a second side, the upper flotation member being generally half-diamond shape in plan with the first end being rounded and the first and second sides being extended to accommodate respective first and second arms extending toward the second end, the upper flotation member having a longitudinal axis and a transverse axis, the second end being straight with respective first and second concave curve members joining the first and second arms to the second end;

the sidewall including a generally U-shaped ramp having first and second feet proximate to the second end of the upper flotation member subjacent to the transverse axis of the upper flotation member on the second side, the generally U-shaped ramp having a rise from the first and second feet to a peak at the first end of the upper flotation member, the generally U-shaped ramp having an upper edge and a lower edge, the upper edge contacting the second side of the upper flotation member and the lower edge extending from the second side of the upper flotation member;

the first end of the upper flotation member being inclined and elevated relative to the second end of the upper flotation member such that the first end of the upper flotation member is configured to provide inclined support to the head, shoulders, and torso of a human utilizing the buoyant pool float; and the U-shaped ramp forming an unsealed air hold proximate the first end of the upper flotation member.

10. The buoyant pool float as recited in claim 9, wherein the upper flotation member further comprises support to at least a portion of the lower body of a human utilizing the buoyant pool float.

11. The buoyant pool float as recited in claim 9, wherein the upper flotation member is substantially flat.

12. The buoyant pool float as recited in claim 9, further comprising a grommet and rope hanger extending from the first end of the upper flotation member, the grommet and rope hanger configured to facilitate hanging of the buoyant pool float for storage.

13. The buoyant pool float as recited in claim 9, wherein the first end of the upper flotation member further comprises a size to accommodate a human head of an individual using the buoyant pool float.

14. The buoyant pool float as recited in claim 9, wherein the second end of the upper flotation member further comprises a size to accommodate human feet of an individual using the buoyant pool float.

15. A buoyant pool float for floating in water, the buoyant pool float comprising:

a body including an upper flotation member and a sidewall extending downward therefrom;

the upper flotation member having a first end, a second end, a first side, and a second side, the upper flotation member being generally oval shape in plan, the upper flotation member having a longitudinal axis and a transverse axis, the second end being substantially straight and truncated;

the sidewall including a generally U-shaped ramp having first and second feet proximate to the second end of the upper flotation member subjacent to the transverse axis of the upper flotation member on the second side, the generally U-shaped ramp having a rise from the first and second feet to a peak at the first end of the upper flotation member, the generally U-shaped ramp having an upper edge and a lower edge, the upper edge contacting the second side of the upper flotation member and the lower edge extending from the second side of the upper flotation member;

the first end of the upper flotation member being inclined and elevated relative to the second end of the upper flotation member such that the first end of the upper flotation member is configured to provide inclined support to the head, shoulders, and torso of a human utilizing the buoyant pool float;

the U-shaped ramp forming an unsealed air hold proximate the first end of the upper flotation member; and a grommet and rope hanger extending from the first end of the upper flotation member, the grommet and rope hanger configured to facilitate hanging of the buoyant pool float for storage.

16. The buoyant pool float as recited in claim 15, wherein the upper flotation member further comprises support to at least a portion of the lower body of a human utilizing the buoyant pool float.

17. The buoyant pool float as recited in claim 15, wherein the upper flotation member is substantially flat.

18. The buoyant pool float as recited in claim 15, wherein the first end of the upper flotation member further comprises a size to accommodate a human head of an individual using the buoyant pool float.

19. The buoyant pool float as recited in claim 15, wherein the second end of the upper flotation member further comprises a size to accommodate human feet of an individual using the buoyant pool float.

* * * * *